United States Patent [19]

Neff et al.

[11] Patent Number: 5,062,584

[45] Date of Patent: Nov. 5, 1991

[54] TARGET DETECTION METHOD FOR FLYING BODIES PROVIDED WITH SEARCH HEAD

[75] Inventors: Franz H. Neff; Jürgen Heinrich, both of Hermannsburg, Fed. Rep. of Germany

[73] Assignee: TZN Forschungs, und Entwicklungszentrum Unterlüss GmbH, Unterlüss, Fed. Rep. of Germany

[21] Appl. No.: 404,909

[22] Filed: Sep. 8, 1989

[30] Foreign Application Priority Data

Oct. 21, 1988 [DE] Fed. Rep. of Germany ..... 3835883

[51] Int. Cl.[5] ..... F41G 7/22

[52] U.S. Cl. ..... 244/3.15

[58] Field of Search ..... 244/3.15, 3.16; 102/384

[56] References Cited

U.S. PATENT DOCUMENTS 4,537,370 8/1985 Pizzurro ..... 244/3.16

4,728,057 3/1988 Dunne ..... 244/3.16

OTHER PUBLICATIONS

Wolfgan Flume, "Artillery Ammunition: Better Effect in the Target" Wehrtechnik Military Technology, 1985, pp. 112–120.

*Primary Examiner*—Brian S. Steinberger

*Attorney, Agent, or Firm*—Spencer & Frank

[57] ABSTRACT

A target detection method for a flying body provided with a search head, with the flying body rotating during its descending flight and scanning the area for possible targets, and in which the geometric dimensions of possible targets are determined in the scanning direction (Y direction) and in a direction perpendicular to the scanning direction (X direction) and are compared with corresponding stored values to determine the presence of a target. To avoid distortions of the scanned target in the Y direction, at least the angular velocity $\omega$ of the flying body, and preferably also the angle $\phi$ between the axis of rotation and the symmetry axis of the flying body, is continuously determined during the scanning process and, image correction values are calculated from the determined values and used to correct the geometric dimensions of the possible target in the Y direction.

10 Claims, 4 Drawing Sheets

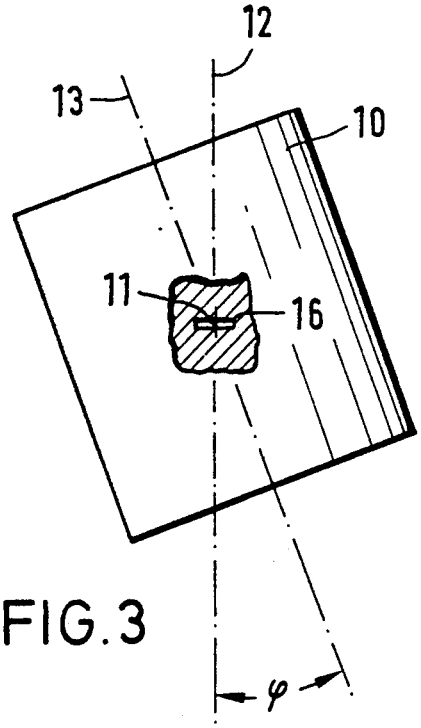
FIG.3
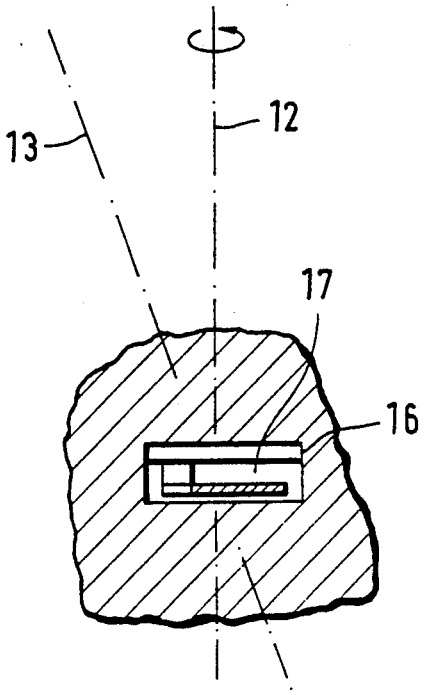
FIG.4
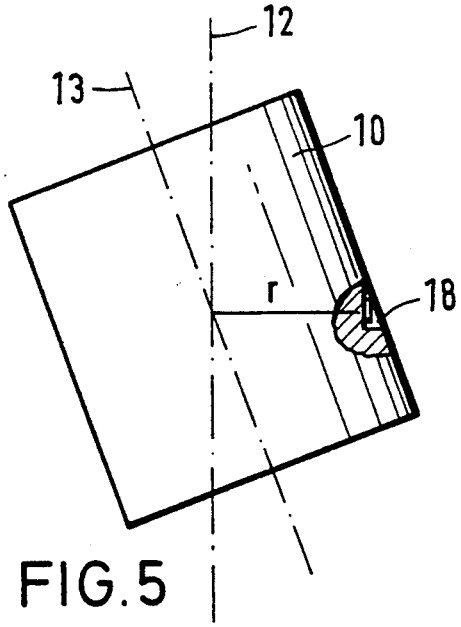
FIG.5
FIG.6
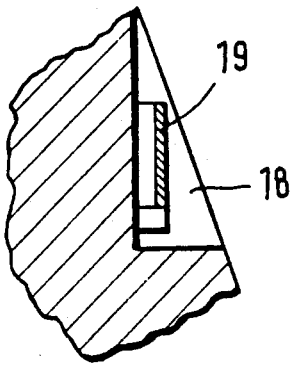

TARGET DETECTION METHOD FOR FLYING BODIES PROVIDED WITH SEARCH HEAD

REFERENCE TO RELATED APPLICATIONS

This application claims the priority of Federal Republic of Germany application Serial No. P 38 35 883.2 filed Oct. 21, 1988, which is incorporated herein by reference.

BACKGROUND OF THE INVENTION

The present invention relates to a target detection method for a flying body provided with a search head, with the flying body rotating during its descending flight and scanning the area with its search head for possible targets, and wherein the geometric dimensions of the possible targets are determined in the direction of the scanning path (Y direction) and in the direction perpendicular to the scanning path (X direction) under consideration of the distance R between the flying body and the possible target, and the determined geometric dimensions are compared with corresponding stored values to detect the presence of a true target.

Such methods are known per se and may be employed in so-called target seeking projectiles. In this regard, see, for example, Flume, "Artilleriemunition: Bessere Wirkung im Ziel," Artillery Ammunition: Better Effect in the Target, Wehrtechnik Military Technology 1985, pages 112 to 120.

Target seeking projectiles or flying bodies are customarily ejected over the target area from a carrier projectile and then drop to the ground while rotating on a parachute. The rotation of the projectile results in the target area being scanned by a search head in the projectile. As soon as a target is detected, a projectile forming charge on board the target seeking projectile is detonated so that the formed projectile can then destroy the target.

In such a method, the target is detected, inter alia, by its geometric dimensions. Targets which exceed or fall below predetermined dimensions are identified as false targets and excluded.

The extent of a target in the X direction results from the number N of detector elements oriented in the X direction of the search head which emit an output signal corresponding to the target temperature (in the case of an infrared detecting search head). The spatial extent results from a predetermined imaging scale and considers the aperture angle $\delta\alpha$ of an element of a row of detectors as well as the distance R between the flying body (projectile) and the target according to the equation $$X = N \cdot R \cdot \delta\alpha \quad (1)$$

To determine the extent of the target in the scanning direction Y, the time T during which the search head scans or detects the target during one revolution is determined. The following then applies:

$$Y = T \cdot V_{SC} \quad (2)$$

where $$V_{SC} = \omega \cdot R \cdot \sin \phi$$

and $\omega$ = the angular velocity of the projectile,

R = the distance between the projectile and the target, $\phi$ = the angle between the rotation axis and the symmetry axis of the projectile.

In the prior art arrangements the term $\omega \cdot \sin \phi$ is assumed to be constant. However, under real conditions, $\omega$ as well as $\phi$ are not constant in time.

Aerodynamic influences in particular, or incomplete opening of the autorotation parachute which causes the target seeking fuze or projectile to rotate, cause a reduction in the angular velocity $\omega$ or also a pendulum movement of the system which leads to fluctuations of $\phi$. The consequences of a reduced angular velocity $\omega$ are lower rpm and scanning velocities $V_{SC}$ so that the target appears to be larger than it really is. Similar conditions apply for deviations of the angle $\phi$. If the target seeking fuze or projectile performs larger pendulum movements in the Y direction, changes of $\phi$ during the searching process make the signature appear distorted.

SUMMARY OF THE INVENTION

It is therefore an object of the present invention to improve a method of the above-mentioned type so that corresponding distortions of the scanned target in the Y direction are as small as possible.

This object is generally achieved according to the invention in that in a target detection method for a flying body of the type which is provided with a search head with the flying body rotating about an axis of rotation during its descending flight and scanning the area with its search head for possible targets, which method includes the steps of determining the geometric dimensions of detected possible targets in the direction of the scanning path (Y direction) and in a direction perpendicular to the scanning path (X direction) under consideration of the distance R between the flying body and the possible target, and comparing the determined geometric dimension values with corresponding stored values to detect the presence of a true target; the actual angular velocity $\omega_{act.}$ of the flying body about the axis of rotation is continuously determined during the scanning process, and the determined angular velocity value $\omega_{act}$ is used to correct the geometric dimension in the Y direction of the possible target during the step of determining the geometric dimensions.

According the preferred embodiment of the invention, the value of the angle $\phi$ between the axis of rotation and the symmetry axis of the flying body is also continuously determined during the scanning process, and the actual determined value of the angle $\phi$ is additionally used to correct the geometric dimension in the Y direction of the possible target during the step of determining the geometric dimensions.

Further details and advantages of the invention will be described in greater detail below with reference to embodiments of the invention and the drawing figures.

BRIEF DESCRIPTION OF THE DRAWINGS

FIG. 3 schematically shows a target seeking projectile provided with an acceleration sensor which is disposed at its center of gravity.

FIG. 4 is a schematic illustration of the acceleration sensor of FIG. 2.

FIG. 5 schematically shows a target seeking projectile provided with an acceleration sensor which is disposed along its edge.

FIG. 6 shows the acceleration sensor employed in FIG. 4.

DETAILED DESCRIPTION OF THE PREFERRED EMBODIMENTS

Figure 1:
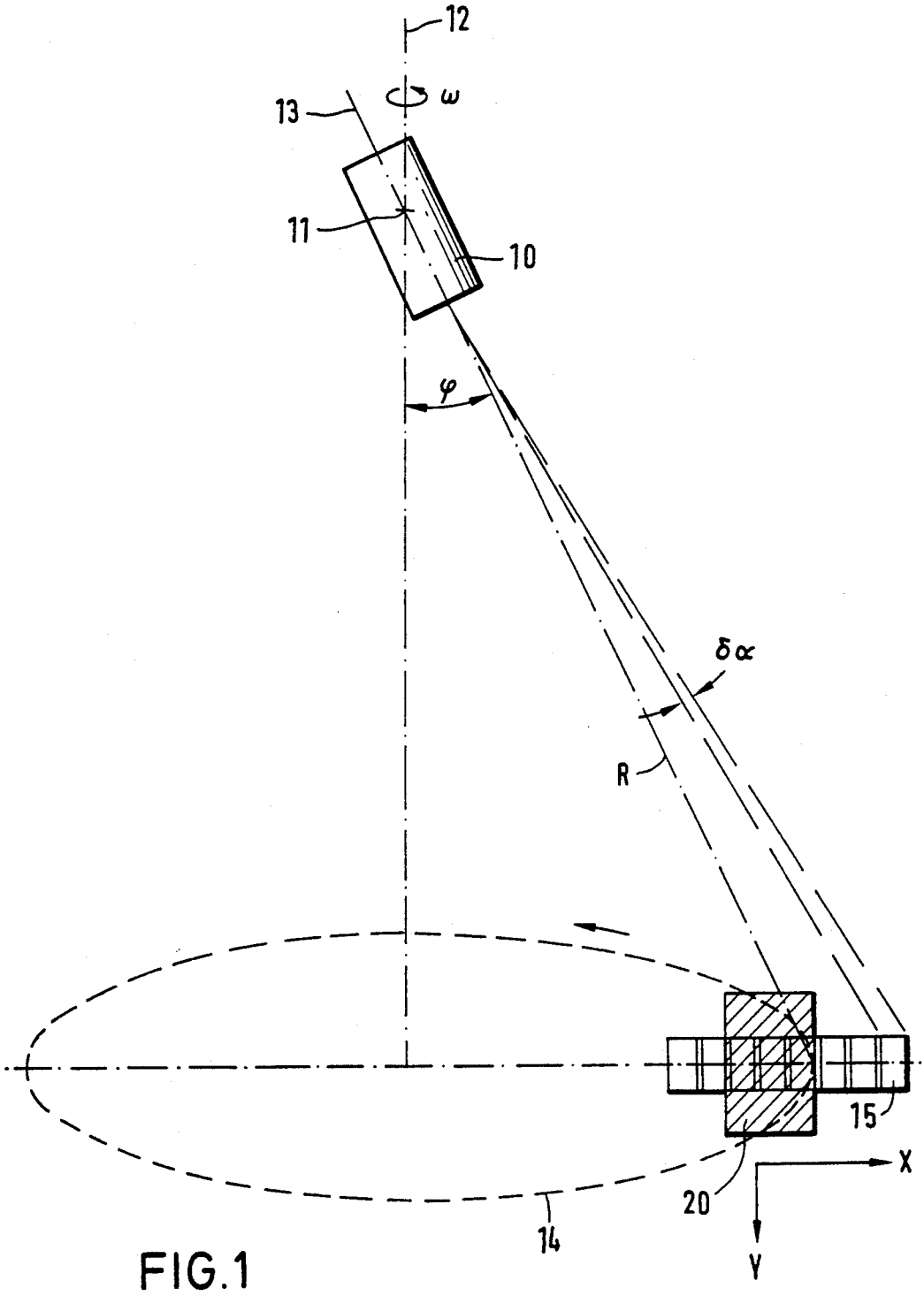
FIG. 1 is a schematic illustration showing a target seeking projectile during scanning of the ground for targets.

In FIG. 1, the numeral 10 identifies a flying body or projectile and the numeral 11 identifies the center of gravity of the flying body. During its descent over a target area, flying body 10 rotates, in a known manner, about an axis of rotation 12 which forms an angle $\phi$ with the symmetry axis 13 of the flying body 10 so that the symmetry axis 13 describes a scanning path 14 on the ground.

Flying body 10 includes an optical imaging system which is not shown in FIG. 1 and which is essentially composed of a row of infrared detectors. This optical imaging system of the target seeking projectile 10 covers a region 15 on the ground which corresponds to the projection of the row of detectors (also called the "footprint"). In the schematic illustration, eight pixels are shown to correspond to the number of elements of the row of detectors, i.e. eight.

A target 20 is also schematically shown by hatching. During the scanning process, this target 20 covers, for example as shown, three pixels in the X direction, As already mentioned above, the geometric dimensions of the target 20 in the X and Y directions are utilized for detection of the target. The dimensions in the X direction result from the number N of detector elements of the detector row which furnish an output signal corresponding to the target temperature. The spatial extent results from the predetermined imaging scale and considers the aperture angle $\delta\alpha$ of an element of the row of detectors as well as the distance R, so that X can be determined with the aid of Equation (1).

The information in the Y direction is determined with the aid of Equation (2), with, according to the invention, the scanning rate $V_{SC}$ being assumed not to be constant. Rather, the scanning rate is continuously determined during the scanning process and the precise extent of the target in the Y direction is calculated. Various modified methods can here be employed alternatively. In the simplest case, $\phi$ is again assumed to be constant and only the angular velocity $\omega$ is measured. However, it is also possible to measure $\phi$ as well as $\omega$ and to determine the extent in the Y direction.

Figure 2:
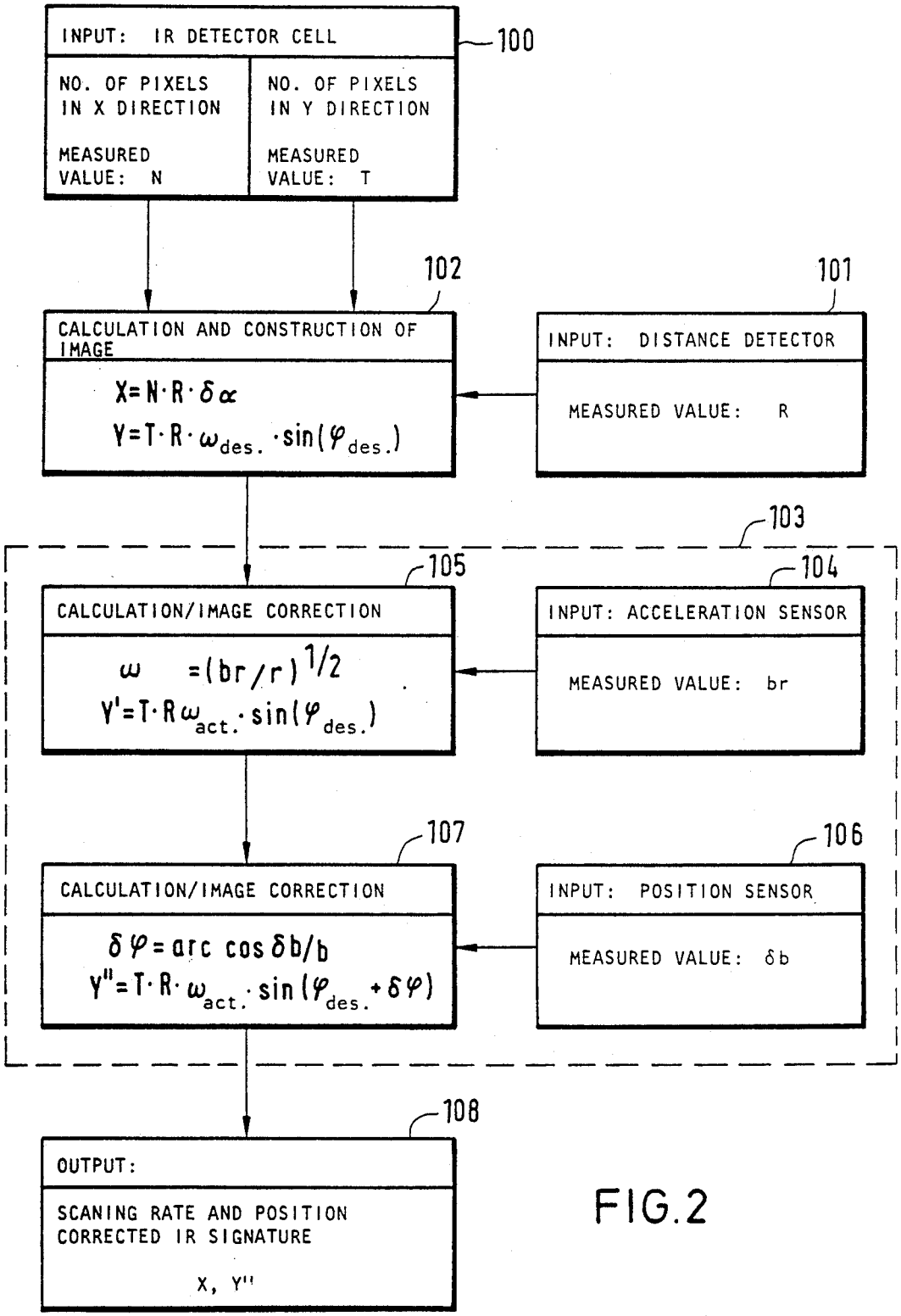
FIG. 2 shows the steps in the sequence of determining the geometric target data according to the preferred embodiment of the method of the invention.

The steps of the method according to the invention will now be described in greater detail with reference to FIG. 2, where $\omega$ as well as a change $\delta\phi$ of $\phi$ are determined.

From the values measured in a known manner for N, T (see block 100) and for R (block 101), and the predetermined desired values for $\delta\phi$, $\omega$ and $\phi$ (indicated by the subscript "des".) the image is initially constructed in a known manner in a memory for the X and Y directions (block 102). In the prior art method, this completes the determination of the signature of the target which is then compared with known stored signature values to identify the presence of a true target.

According to the invention, the Y values are now corrected via steps included in the dashed field 103. For this purpose, the radial acceleration br of the flying body 10 is first measured by means of an acceleration sensor (block 104) provided on the flying body and from this measured radial acceleration the actual angular velocity $\omega_{act.}$ is determined with the aid of the following equation:

$$\omega_{act.}=(br/r)^{\frac{1}{2}} \tag{3}$$

where r is the perpendicular distance between the axis of rotation 12 and the location of the acceleration sensor. Then the Y value is corrected for the first time (block 105) in that the value $\omega_{des.}$, which was assumed to be constant, is replaced by Equation (3) so that the corrected value Y' results as follows:

$$Y'=T\cdot R\cdot\omega_{act.}\cdot\sin(\phi_{des.})$$

As indicated above, the signature values for X calculated in a block 102 and for Y' calculated in block 105 can then be used as the output IR (infrared) signature for comparison with a stored signature value. However, according to the preferred embodiment and in order to correct the position and the change in the angle $\phi$ due to pendulum movements, a further acceleration sensor is employed to measure the respective fluctuations in acceleration $\delta b$ of the projectile (block 106). The corresponding values for $\delta\phi$, i.e., the changes in angle $\phi$, can then be determined from values $\delta b$ with the aid of the following equation:

$$\delta\phi=\arccos(\delta b/b_{des.}) \tag{4}$$

where $b_{des.}$ is the desired acceleration value in the direction of the axis of rotation 12 corresponding to the predetermined desired angle $\phi_{des.}$. Then the original Y value is corrected for the second time (block 107) so that $$Y''=T\cdot R\cdot\omega_{act.}\cdot\sin(\phi_{des.}+\delta\phi)$$

The resulting output values for X and Y'' are then IR signature values that are corrected with respect to scanning rate and position (block 108).

FIGS. 3 and 4 show the basic structure of an acceleration sensor 16 in flying body 10 for a determination of the position or deviation of the axis of rotation 13 relative to the direction of earth acceleration g. For this purpose, a position and acceleration sensor 16 is preferably disposed at the center of gravity 11 of flying body 10. If a solid state acceleration sensor is employed which is based on a cantilever 17 being bent to determine the acceleration of the earth, sensor 16 is attached in such a manner that cantilever 17 is oriented perpendicularly to the direction of g and in this position indicates the maximum earth acceleration value. Deviations of the resulting determined acceleration $\delta b$ from the desired acceleration $b_{des.}$ can then be concluded to be a deviating position of the axis of rotation 12 of the target seeking fuze or projectile 10 in space and can be calculated with the aid of Equation (4).

FIGS. 5 and 6 show an arrangement for the determination of radial acceleration br. An acceleration sensor 18 is mounted on the projectile 10 outside of the axis of rotation 12 at a fixed distance r in such a manner that the occurring radial acceleration br is oriented perpendicularly to the axis of rotation 12 and only this component is recorded.

For an acceleration sensor 18 which is based on the bending of a cantilever 19, the acceleration sensor 18 is attached in such a manner that cantilever 19 is oriented parallel to the axis of rotation 12. The angular velocity is then calculated with the aid of Equation (3).

Figure 7:
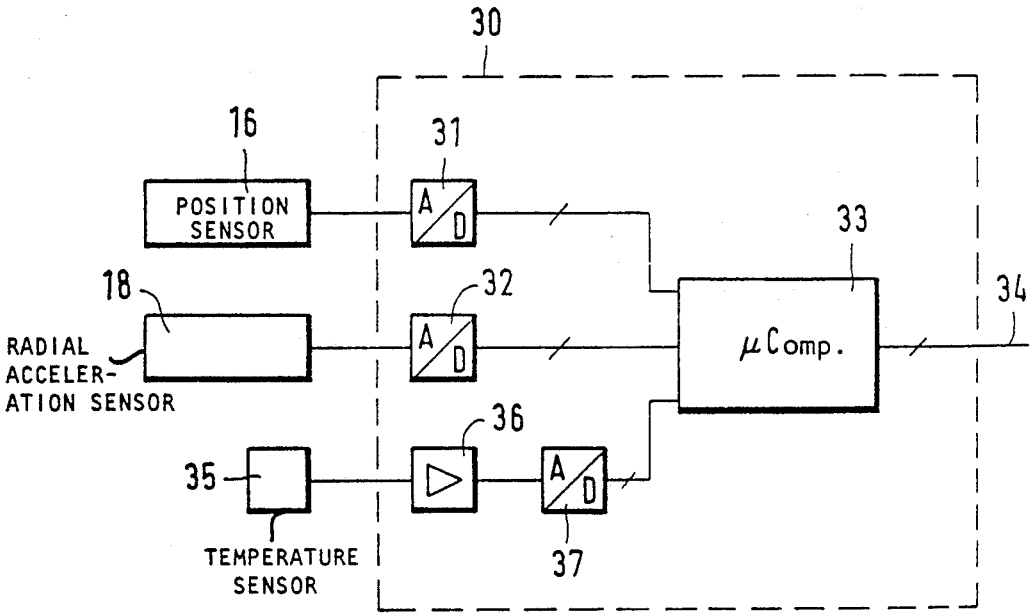
FIG. 7 shows a basic block circuit diagram for evaluation of the sensor signals.

FIG. 7 is a schematic representation of a block circuit diagram for an electronic evaluation system 30 for the measured signals.

As shown in this Figure, the signal from the acceleration sensors 16 and 18 are fed through respective A/D converters 31 and 32 to a microcomputer (μComp.) 33, which determines the angular velocities ω, the position deviations δφ and the dimensions X and Y' or Y'' of the scanned target and compares the dimension values with predetermined values. If necessary, detonation signals are then given to a detonator (not shown) via a line 34.

In order to consider possible deviations due to changes in temperature, the temperature in the vicinity of acceleration sensors 16 and 18 is measured by means of a thermoelement 35 and is fed via an amplifier 36 and an A/D converter 37 to microcomputer 33 so that the data for acceleration values br and δb can be corrected for temperature in a known manner.

The invention now being fully described, it will be apparent to one of ordinary skill in the art that any changes and modifications can be made thereto without departing from the spirit or scope of the invention as set forth herein.

What is claimed is:

1. In a target detection method for a flying body provided with a search head and with the flying body rotating about an axis of rotation during its descending flight and scanning the area with its search head for possible targets, said method including the steps of determining the geometric dimensions of detected possible targets in the direction of the scanning path (Y direction) and in a direction perpendicular to the scanning path (X direction) under consideration of the distance R between the flying body and the possible target, and comparing the determined geometrical dimension values with corresponding stored values to detect the presence of a true target; the improvement comprising: continuously determining the actual angular velocity $\omega_{act.}$ of the flying body about the axis of rotation during the scanning process by (a) measuring the radial acceleration (br) of the flying body by means of an acceleration sensor mounted on the flying body so that it is radially displaced from the axis of rotation, and calculating $\omega_{act.}$ from the equation $$\omega_{act.} = (br/r)^{\frac{1}{2}}$$

where r is the distance between the axis of rotation and the location of the acceleration sensor; and using the determined angular velocity value $\omega_{act.}$ to correct the geometric dimension in the Y direction of the possible target during said step of determining the geometric dimensions.

2. The method defined in claim 1, further comprising: continuously determining the value of the angle φ between the axis of rotation and the symmetry axis of the flying body during the scanning process; and additionally using the actual determined value of the angle φ to correct the geometric dimension in the Y direction of the possible target during said step of determining the geometric dimensions.

3. The method defined in claim 1, further comprising: during the scanning process, continuously determining changes in the angle φ between the axis of rotation and the symmetry axis of the flying body relative to a predetermined desired angle $\phi_{des.}$ to provide an angle value δφ; and additionally using the determined value δφ to correct the geometric dimension in the Y direction of the possible target during said step of determining the geometric dimensions.

4. The method defined in claim 3, wherein said step of continuously determining changes in the angle φ to provide the angle value δφ comprises: measuring changes in acceleration δb in the direction of the axis of rotation of the flying body; and calculating δφ from the following equation:

$$\delta\phi = \arccos(\delta b / b_{des.})$$

where $b_{des.}$ is the acceleration value in the direction of the axis of rotation corresponding to the predetermined angle $\phi_{des.}$.

5. In a target detection method for a flying body provided with a search head and with the flying body rotating about an axis of rotation during its descending flight and scanning the area with its search head for possible targets, said method including the steps of determining the geometric dimensions of detected possible targets in the direction of the scanning path (Y direction) and in a direction perpendicular to the scanning path (X direction) under consideration of the distance R between the flying body and the possible target, and comparing the determined geometrical dimension values with corresponding stored values to detect the presence of a true target; the improvement comprising: continuously determining the actual angular velocity $\omega_{act.}$ of the flying body about the axis of rotation during the scanning process and using the determined angular velocity value $\omega_{act.}$ to correct the geometric dimension in the Y direction of the possible target during said step of determining the geometric dimensions; and wherein the corrected geometric dimension in the Y direction is determined according to the following equation:

$$Y = T \cdot R \cdot \omega_{act.} (\sin \phi)$$

where T is the time during one revolution of the projectile when the search head detects a possible target, and φ is the angle between the axis of rotation and the axis of symmetry of the flying body.

6. In a target detection method for a flying body provided with a search head and with the flying body rotating about an axis of rotation during its descending flight and scanning the area with its search head for possible targets, said method including the steps of determining the geometric dimensions of detected possible targets in the direction of the scanning path (Y direction) and in a direction perpendicular to the scanning path (X direction) under consideration of the distance R between the flying body and the possible target, and comparing the determined geometrical dimension values with corresponding stored values to detect the presence of a true target; the improvement comprising: continuously determining the actual angular velocity $\omega_{act.}$ of the flying body about the axis of rotation during the scanning process; continuously determining the value of the angle φ between the axis of rotation and the symmetry axis of the flying body during the scanning process; and using both the determined angular velocity value $\omega_{act.}$ and the actual determined value $\phi_{act.}$ of the angle φ to correct the geometric dimension in the Y direction of the possible target during said step of determining the geometric dimensions.

7. The method defined in claim 6, wherein the corrected geometric dimension in the Y direction is determined according to the following equation:

$$Y' = T \cdot R \cdot \omega_{act.} (\sin \phi_{act.})$$

where T is the time during one revolution of the flying body when the search head detects a possible target, and R is the distance between the flying body and the possible target.

8. In a target detection method for a flying body provided with a search head and with the flying body rotating about an axis of rotation during its descending flight and scanning the area with its search head for possible targets, said method including the steps of determining the geometric dimensions of detected possible targets in the direction of the scanning path (Y direction) and in a direction perpendicular to the scanning path (X direction) under consideration of the distance R between the flying body and the possible target, and comparing the determined geometrical dimension values with corresponding stored values to detect the presence of a true target; the improvement comprising: during the scanning process, continuously determining the actual angular velocity $\omega_{act.}$ of the flying body about the axis of rotation and continuously determining change in the angle $\phi$ between the axis of rotation nd the symmetry axis of the flying body relative to a predetermined desired angle $\phi_{des.}$ to provide an angle value $\delta\phi$; and using both the determined angular velocity value $\omega_{act.}$ and the determined value $\delta\phi$ to correct the geometric dimension in the Y direction of the possible target during said step of determining the geometric dimensions.

9. The method defined in claim 8 wherein said step of continuously determining changes in the angle $\phi$ to provide the angle value $\delta\phi$ comprises: measuring changes in acceleration $\delta b$ of the flying body in the direction of the axis of rotation of the flying body; and calculating $\delta\phi$ from the following equation:

$$\delta\omega = \text{arc cos } (\delta b / b_{des.})$$

where $b_{des.}$ is the acceleration value in the direction of the axis of rotation corresponding to the predetermined angle $\phi_{des.}$.

10. The method as defined in claim 9 wherein the corrected geometric dimension in the Y direction is determined according to the following equation:

$$Y'' = T \cdot R \cdot \omega_{act.} (\sin \phi_{des.} + \delta\phi)$$

where T is the time during one revolution of the flying body when the search head detects a possible target, and R is the distance between the flying body and the possible target.

* * * * *